United States Patent [19]

Nishimura et al.

[11] Patent Number: 4,655,166

[45] Date of Patent: Apr. 7, 1987

[54] APPARATUS FOR PREVENTING OSCILLATION OF RUNNING STRIP

[75] Inventors: Kazuyoshi Nishimura, Ichikawa; Kenji Tabushi, Chiba; Tadashi Nishino; Tomoaki Kimura, both of Hitachi, all of Japan

[73] Assignees: Hitachi, Ltd.; Nisshin Steel Co., Ltd., both of Tokyo, Japan

[21] Appl. No.: 462,972

[22] Filed: Feb. 1, 1983

Related U.S. Application Data

[63] Continuation of Ser. No. 215,071, Dec. 10, 1980, abandoned.

[30] Foreign Application Priority Data

Dec. 26, 1979 [JP] Japan ..... 54-168407
Jun. 13, 1980 [JP] Japan ..... 55-78902

[51] Int. Cl.[4] ..... B05C 11/00
[52] U.S. Cl. ..... 118/673; 118/63; 118/419
[58] Field of Search ..... 427/47; 118/673, 63, 118/68, 419, 623

[56] References Cited

U.S. PATENT DOCUMENTS

| | | | |
|---|---|---|---|
| 2,731,212 | 1/1956 | Baker . | |
| 3,602,191 | 8/1971 | Gorton | 118/673 |
| 3,661,116 | 5/1972 | Moskowitz et al. | 118/673 |
| 4,033,398 | 7/1977 | Laithwaite | 427/47 X |

FOREIGN PATENT DOCUMENTS

| | | |
|---|---|---|
| 1346992 | 2/1974 | United Kingdom . |

*Primary Examiner*—Bernard D. Pianalto
*Attorney, Agent, or Firm*—Fay, Sharpe, Beall, Fagan, Minnich & McKee

[57] ABSTRACT

In a continuous galvanizing line, oscillation of a steel strip withdrawn from a molten zinc metal bath is prevented by anti-vibration magnets disposed in the vicinity of the respective side edges of the steel strip. The magnets cause tension in the strip in a direction of strip width and amplitude of the oscillation of the strip perpendicular to the strip surfaces is reduced. Also, by magnetic force of the magnet, bending of the running strip is cured and uniform coating is obtained. A gap between the magnet and the strip side edge is automatically controlled by detecting the gap continuously.

21 Claims, 10 Drawing Figures

APPARATUS FOR PREVENTING OSCILLATION OF RUNNING STRIP

This is a continuation of application Ser. No. 215,071, filed Dec. 10, 1980, now abandoned.

BACKGROUND AND SUMMARY OF THE INVENTION

The present invention relates to a method and apparatus for preventing oscillation of magnetic strip material which is continuously treated while the strip is running in various processing lines such as continuous galvanizing lines, annealing lines, pickling lines and inspection lines.

In these processing lines, various treatments and inspections of the strip usually have to be conducted while the strip is running in a high line speed. For example, thickness control for the material to be coated on a strip in a continuous galvanizing line is conducted while the strip is running at a line speed of 200 m/min or more. Also, flow or thickness detections of a strip material have to be made while the strip is running.

Usually, these running strips are supported at a certain distance by a pair of rollers or pinch rollers with a tension imparting on the strip in the strip running direction. In the strip between the adjacent rollers, various types of problems arise such as oscillation in a direction of strip thickness and strip width, and also deformation of strip surfaces into a convex or concave shape. These problems become serious as the line speed of the strip increases and cause deteriorations of the strip quality due to lack of accuracy in the treatment and detection errors in the flaw inspections or thickness detections of the strip.

An object of the present invention is to provide a method and apparatus for preventing oscillation or deformation of a strip which arise in the strip while the strip is running.

According to the present invention, oscillation or deformation of a running strip can be reduced by applying a magnetic field in the direction of strip width. The magnetic field acts to attract the side edge of the strip in the direction of the magnetic field and causes a tension in the strip in the direction of the strip width, so that amplitude of strip oscillation is reduced and also bending of strip in the strip width is cured.

As a magnetic means to cause the magnetic field, any type of means to cause a magnetic field, such as permanent magnet, linear motor, solenoid, are applicable. Also any kind of strip or sheet which is made of magnetic material can be applicable to the present invention.

According to a feature of the present invention, magnetic means to produce a magnetic field is located along a passage of a running strip in the vicinity of the strip side edge in a non contacting manner so that the strip side edge is attracted to the direction of the magnetic field and a tension is imparted to the strip in the direction of the strip width. The location of the magnetic means is preferably adjusted so that a desired gap between the magnetic means and the side edge is maintained.

According to another feature of the present invention, the magnetic means is adapted for the prevention of strip oscillation in a continuous metal coating apparatus so that uniform thickness of the coating metal is advantageously obtained due to suppression of the strip oscillation. Also, by the use of the magnetic means, bending of the strip is advantageously eliminated which results in improved coating surfaces of the strip. The magnetic means is further applicable for the prevention of strip oscillation or bending other than in the continuous metal coating apparatus, such as continuous strip inspection lines.

These and further objects, features and advantages of the present invention will become more obvious from the following description when taken in connection with the accompanying drawings which show, for purposes of illustration, several embodiments in accordance with the present invention.

DESCRIPTION OF PREFERRED EMBODIMENTS

Figure 1:
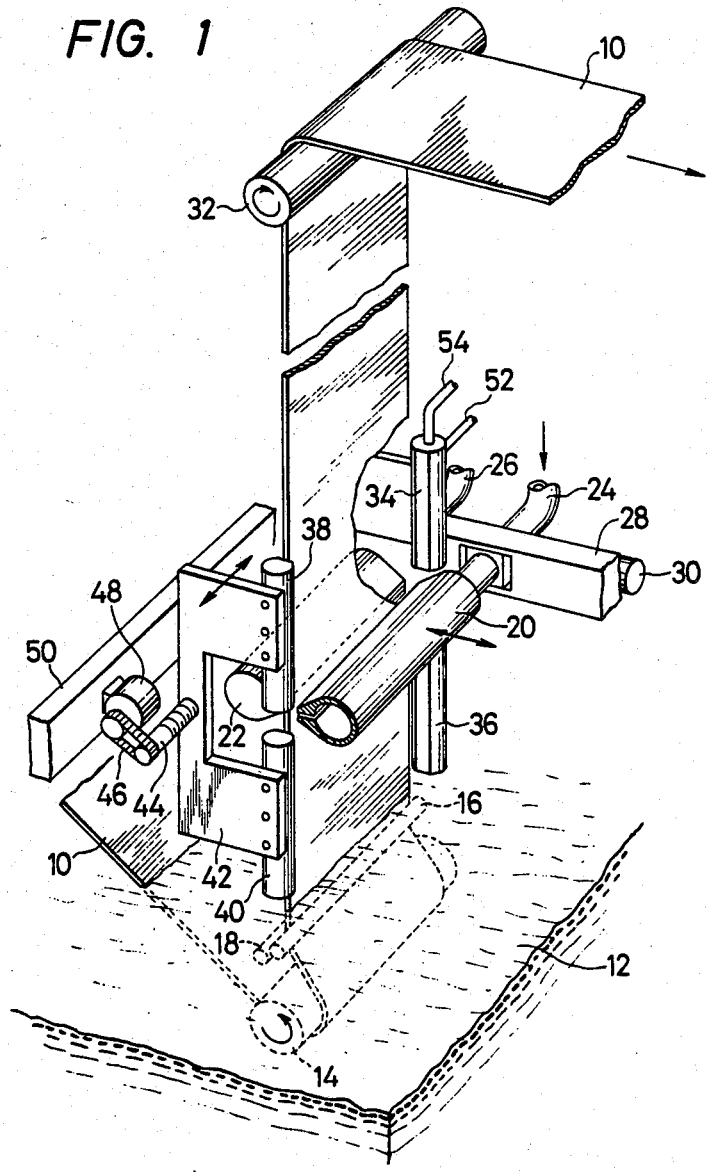
FIG. 1 is a perspective view of a continuous galvanizing apparatus having the magnetic means in accordance with the present invention.

FIG. 1 shows one embodiment of the invention in which the magnetic means, hereafter called anti-vibration magnet, is adopted to a continuous galvanizing apparatus having gas wiping nozzles. The galvanizing apparatus comprises a bottom roller 14, a pair of deflect rollers 16 and 18, top roller 32 for continuously feeding a steel strip 10 into a molten zinc bath 12, and a pair of gas wiping nozzles 20 and 22 disposed above the surface of the molten zinc bath 12 and adapted for effecting a gas wiping on the coated steel strip 10. In this galvanizing apparatus, coating thickness on the surface of the steel strip is controlled by spraying jet gas from the wiping nozzles 20 and 22 installed above the surface of the bath 12 on both sides of the strip as it is withdrawn from the molten zinc bath 12. The thickness is usually adjusted by varying the distance between the front nozzle 20 and rear nozzle 22, pressure of the gas jet and velocity of the strip running speed.

The wiping nozzles 20 and 22 are slidably supported by a frame 28. The distance between the strip 10 and the wiping nozzles 20 and 22 is adjusted by a control motor 30. By operating the control motor 30, the wiping nozzles 20 and 22 can be moved parallelly apart from or close to the front and rear surfaces of the strip 10. The wiping gas is introduced to the wiping nozzles 20 and 22 respectively from pipes 24 and 26.

The steel strip, after being withdrawn from the zinc bath 12, can not be supported in any direct contacting manner until the coating metal is cooled and solidified, so that the position of the top roller 32 becomes higher in proportion to the strip running speed. Practically, a free span of about 40 m height is necessary when the running speed is 200 m/min. The increase of the length of the free span and the increase of the strip running speed act to promote the oscillation and deformation of the strip 10, so that the distance between the wiping nozzles 20 and 22 and the strip surfaces must be continuously controlled or maintained larger. For instance, the strip 10 makes a lateral oscillation of amplitude of 3 to 10 mm at a frequency of 1 to 7 Hz. The dynamic pressure of the gas jet from the nozzles 20 and 22 varies by the lateral oscillation of the strip. The thickness of the coating metal on the strip 10 is reduced when the distance is deduced, and increased when the distance is increased, thereby causes nonuniform thickness of the coating layers.

For the above reasons, there has been an increased demand for a galvanizing apparatus capable of making a uniform coating layer at high line speed. Although, it has been proposed to reduce the thickness of the coating layer by increasing the pressure of the wiping gas, the pressure can be increased only to 0.6 kg/cm$^2$ or so, because the level of noise increases due to the gas pressure. According to the present embodiment of the invention, there are provided four anti-vibration magnet units 34, 36, 38 and 40 in the close proximity of side edges of the strip. By the magnet force of the magnet units, the side edges of the running strip are each attracted to a region where the magnetic flux density is higher, so that the oscillation of the strip is prevented. The magnetic units 38 and 40 are secured to a side plate 42 and the magnet units 34 and 36 are secured to another side plate, which side plates are located near the respective side edges of the strip.

Furthermore, in order to maintain the steel strip in a region where the steel strip is stably held, it is necessary to keep a constant small gap between the magnet units and the side edges of the strip. Practically, windings of the strip or changes in the strip width are inevitable. For the above reason, the side plates 42 are slidably supported by a frame 50 with a screw rod 44 which is coupled to a control motor 48 through a belt 46. The side plate 42 can be moved parallel apart from or close to the side edge of the strip by driving the control motor 48 so that a desired gap may be maintained constant between the magnet units 38, 40 and the corresponding side edge of the strip. The magnet units 34 and 36 are also capable to move in the direction of strip width so as to keep a desired gap between the magnet units 34, 36 and the corresponding side edge of the strip.

In the present embodiment of the invention, four magnet units 34, 36, 38 and 40 are employed to prevent the oscillation of the strip, however, the number of the magnets is not limited to the embodiment. For example, only upper magnet units 34 and 38 can be employed. Also, if the case allows, only one magnet unit, for example, the magnet unit 34 can be employed. Further, the location of the magnet units are not limited to the embodiment. In the case of the gas wiping type galvanizing apparatus, prevention of strip oscillation between the wiping nozzles 20 and 22 is most effective for obtaining uniform thickness of the coating metal. For the above reason, it is preferable to locate the magnet unit near the side edge of the strip between two wiping nozzles 20 and 22 where the magnet force of the magnet unit becomes the largest.

In the present invention, the deflect rollers 16 and 18 are employed to secure stable galvanizing, however, these deflect rollers may promote strip oscillation due to fitting error in bearing portions or eccentricity of the rollers by the heat deformation. Therefore, it is preferable to omit these deflect rollers to ensure the effect of the magnet unit.

Figure 2:
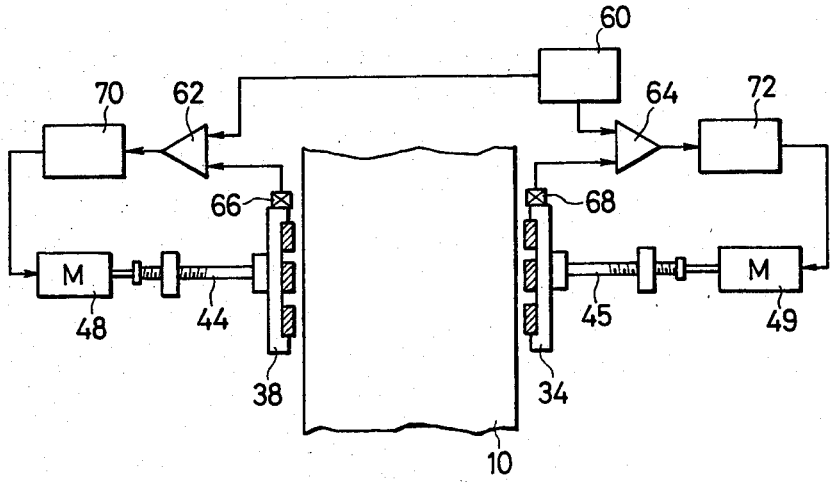
FIG. 2 is a circuit diagram according to one embodiment of the present invention.

Referring now to FIG. 2, in which the magnet units 34 and 38 are located in the vicinity of respective side edges of the strip 10. The magnet units 34 and 38 are respectively provided with detectors 68 and 66 adapted to detect the gap between the side edge of the strip 10 and the magnet units. As the detector, photodetector or other type of position detectors can be applicable. Signals from the detectors 66 and 68 are delivered to comparators 62 and 64 where a preset signal produced in a preset circuit 60 is introduced. The comparator 62 and 64 produce signals corresponding to the actual detected signals and the preset signal. The out put signals from the comparators 62 and 64 are respectively transmitted through amplifiers 70 and 72 to the control motors 48 and 49. The screw rods 44 and 45 connected to the magnetic units 38 and 34 are coupled to the output shafts of the control motor 48 and 49, therefore, the magnetic units can be shifted as the screw rods are driven by the motors.

According to this arrangement, if the actual gap between the magnetic unit and the strip side edge is not equal to the predetermined desired valve, the control motor is actuated in accordance with the signal representing the deviation, so that the magnetic unit is located at the predetermined desired position. In this way, the gap between the magnetic unit and the strip side edge is adjusted such that the magnetic force applied to the strip side edge is maintained substantially constant.

Figure 3:
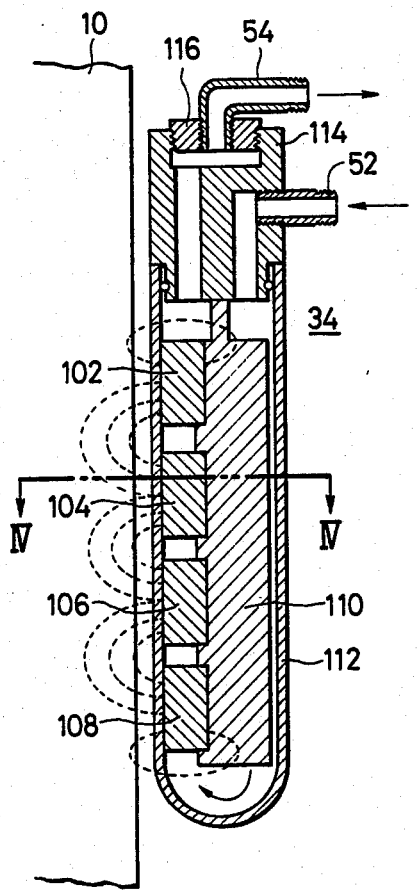
FIG. 3 is an enlarged cross section view of the magnetic means in FIG. 1 of the present invention.
Figure 4:
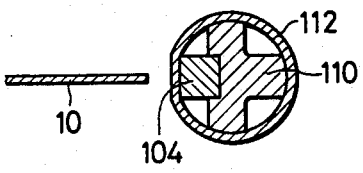
FIG. 4 is a cross section view taken along the line IV—IV of FIG. 3.

Hereafter the details of the magnet units will be explained with respect to FIGS. 3 and 4. In the case of the galvanizing apparatus, it is preferable to locate the magnet unit near the wiping nozzle for the above reasons, however, the magnet unit has to be disposed under a hard thermal radiation from the melting metal and the hot wiping gas. Especially, a permanent magnet is thermally unstable and it is very easy to decrease its magnetic force by the heat. In order to solve the problem, the magnet unit 34 is formed of a cylindrical sealed vessel 112 enclosing a plurality of permanent magnets 102, 104, 106 and 108, through which cooling liquid circulates. The permanent magnets 102, 104, 106 and 108 are secured to a T shaped partition wall 110 which defines a passage for the cooling liquid in the sealing vessel 112. The magnets are secured in recesses formed on the surface of the wall 110 and project toward an inner wall of the vessel 112. At the upper end of the vessel, there is secured seal caps 114 and 116 having an entrance pipe 52 and an exit pipe 54 for the cooling liquid. This sealing vessel 112 is located near the side edge of the strip 10 such that the magnets 102, 104, 106 and 108 face the side edge of the strip 10. In order to enhance the effect of the magnet unit 34, it is preferable to use non-magnetic and high thermal conductive materials as the sealing vessel 112 such as copper. Also, it is preferable to use a thin material for the sealing vessel 112. According to this embodiment, reduction of magnet force by the heat can be eliminated. Also, adhesion of splashed molten metal to the magnets or the sealing vessel 112 can be prevented.

In the present embodiment, it is preferrable to locate the magnets 102, 104, 106 and 108 on partition wall 110 such that the direction of magnet field of the respective magnets may be in the order of SNS or NSN so that the most effective magnetic field can be obtained. Also, it is preferrable to use a nonmagnetic material for the vessel to enhance the effect of the anti-vibration magnets.

Figure 5:
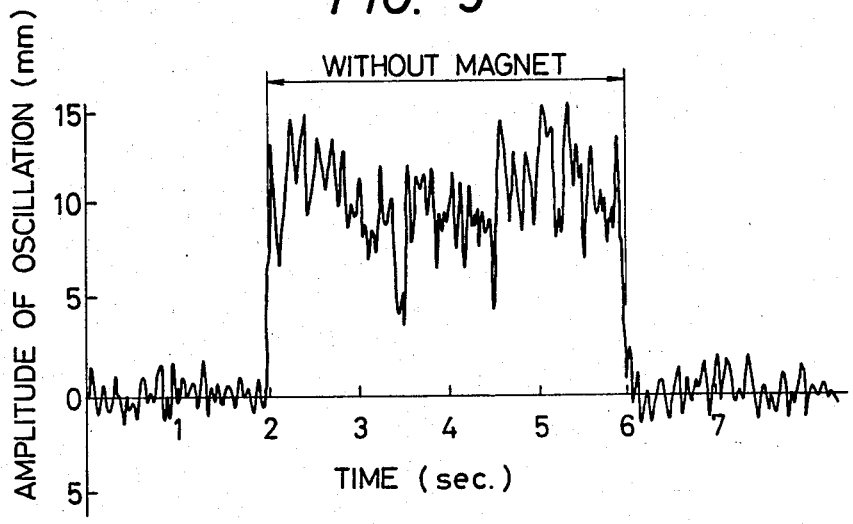
FIG. 5 is a graph showing a test result of amplitudes of strip oscillation with and without the magnetic means of the present invention, FIGS. 6(*a*) and (*b*) are schematic graphs respectively showing test results of amplitudes of oscillation without and with the magnetic means of the present invention.
Figure 6A:
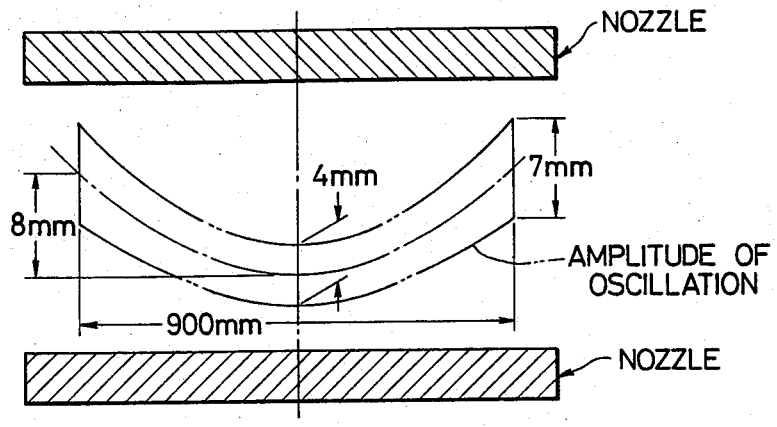
Figure 6B:
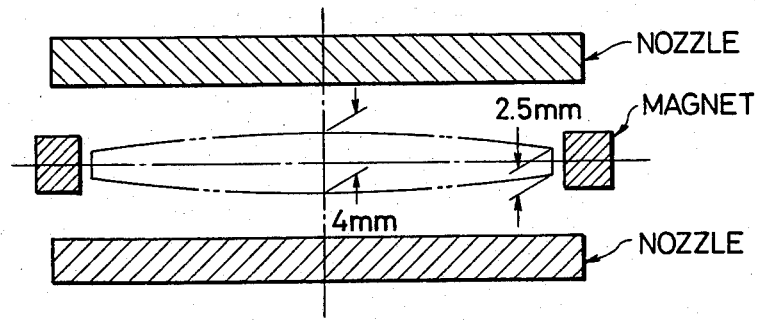

FIG. 5 is a graph showing the strip oscillation preventing effect performed by the anti-vibration magnet, in which the magnet is removed apart from the strip side edge so as not to effect magnetic force to the strip as shown from time 2 to 6 sec. As is apparent from the graph, if the magnet force is effected to the strip, the amplitude of strip oscillation is kept at most 2 to 3 mm, while the amplitude is about 10 mm if the magnet is removed apart from the strip side edge. The oscillation preventing effect will be more apparent from the experiments in which continuous galvanizing is effected by the apparatus shown in FIG. 1 with a steel strip having a thickness of 1.20 mm, the strip width of 1000 mm, at a line speed of 123 m/min, and amount of zinc 300 g/m$^2$. FIGS. 6(*a*) and 6(*b*) show the results of experiments, respectively without and with the anti-vibration magnets. The results show that, if the magnet is not employed, the maximum amplitude of strip oscillation about 7 mm appears at the side edge of the strip and the minimum amplitude of strip oscillation of 4 mm appears at the middle of the strip width. Also, the strip is deformed or bent backward like so that the cross section of the strip becomes a concave or convex shape if the magnet is not employed. The amount of the bending or deformation, usually called "canoeing", is about 8 mm. On the other hand, if the anti-vibration magnet is located near the side edges of the strip as shown in FIG. 6(*b*), not only the amplitude of oscillation at the edge portion becomes smaller (2.5 mm) but also the canoeing disappears.

The effect of the anti-vibration magnet will be more apparent from the following Table 1, in which thickness of coating metal on the surface of the resultant strips are measured in accordance with the present invention with the anti-vibration magnet and the conventional galvanizing method without the anti-vibration magnet. The strip to be measured was made by gas wiping method such that a steel strip having a thickness of 1.20 mm and a width of 1000 mm was coated at line speed of 123 m/min with an expected amount of zinc to be coated 300 g/m$^2$. The measurement was made by so called "3 point method" in accordance with the Japanese Industrial Standard H0401 "Test method for galvanized strip". 10 test pieces were sampled from the resultant strips at an equal distance with respect to the direction of the strip width, and the weight of zinc coated on the test pieces were measured by the so called "antimany method".

As is shown from Table 1, the thickness of coating is not uniform by the conventional method. Especially, due to the deformation or bending of the strip (canoeing), the thickness of the coating is thinner at side portions and thicker at the middle portion on the front side of the strip, and thicker at side portions and thinner at the middle portion on the rear side of the strip. On the other hand, according to the present invention with the anti-vibration magnet, the thickness of coating is uniform at the entire portions on both sides of the strip, which proves that the anti-vibration magnet is effective not only to prevent lateral oscillation but also deformation or bending such as canoeing of the strip.

TABLE 1

| | Side of strip | Weight of zinc (g/m$^2$) Test points in the direction of strip width 1 | 2 | 3 | 4 | 5 | 6 | 7 | 8 | 9 | 10 | Average |
|---|---|---|---|---|---|---|---|---|---|---|---|---|
| Present Invention (with magnet) | Front | 150 | 152 | 151 | 150 | 146 | 148 | 150 | 154 | 150 | 148 | 149.9 |
| | Rear | 150 | 154 | 152 | 156 | 155 | 152 | 154 | 148 | 151 | 152 | 152.4 |
| | Total | 300 | 306 | 303 | 306 | 301 | 300 | 304 | 302 | 301 | 300 | 302.3 |
| Conventional Method (without magnet) | Front | 142 | 147 | 150 | 157 | 163 | 153 | 150 | 158 | 140 | 145 | 150.5 |
| | Rear | 154 | 152 | 150 | 143 | 145 | 143 | 150 | 150 | 155 | 152 | 149.4 |
| | Total | 296 | 299 | 300 | 300 | 308 | 296 | 300 | 303 | 295 | 297 | 299.4 |

Figure 7:
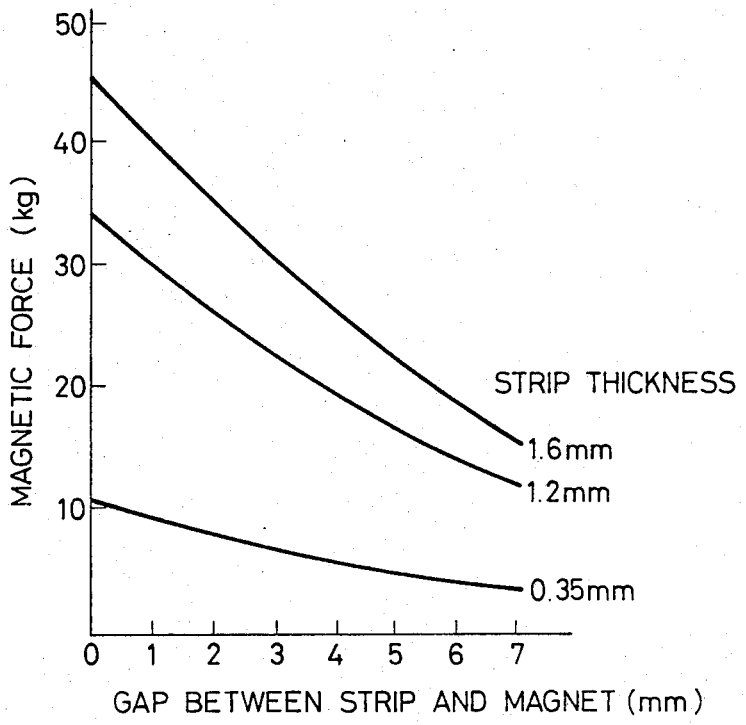
FIG. 7 is a graph showing relations between the magnet force and a gap between the strip and the magnetic means.

FIG. 7 shows a relations of magnet force applied to a steel strip and gap between the strip side edge and the magnet surface. The magnet used in this test result is formed of a plurality of rectangular magnet pieces made of cobalt magnet stacked to form a magnet unit as shown in FIG. 3. The effective length of the magnet unit facing the strip side edge is about 500 mm. As is shown from FIG. 7, the magnet force decreases with the increase of the gap. Also the magnet force decreases if the strip becomes thinner. Considering the reliability of the gap controlling mechanism, it is preferable to keep a gap of about 4 to 6 mm so that magnetic force of about 5 to 25 kg m/sec$^2$ may be obtained.

Figure 8:
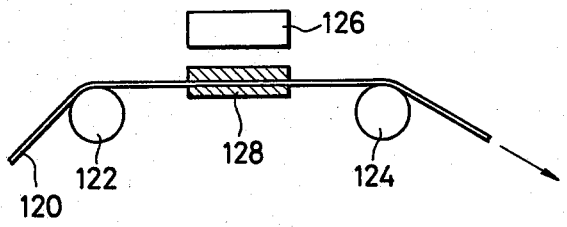
FIG. 8 is a schematic side view of another embodiment of the present invention.

FIG. 8 shows another embodiment of the present invention in which the anti-vibration magnet is applied to a continuous strip inspection line. A strip 120 is running over a pair of rollers 122 and 124. A strip detector 126 for detecting the flaw or thickness of the strip 120 by laser beam or X-ray is disposed along the passage of the strip between the rollers 122 and 124 anti-vibrating magnets 128 are disposed in the vicinity of respective side edges of the strip 120 below the detector 126. By this arrangement of the magnets 128, detection error due to oscillation, deformation or bending of the strip is prevented for the oscillation or deformation of the strip is effectively suppressed by the magnets.

Figure 9:
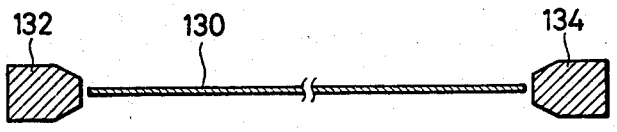
FIG. 9 is a schematic section view of another embodiment of a magnetic means of the present invention.

It is effective and preferrable to make the magnet having a narrowed tip 132 and 134 as shown in FIG. 9, because, by so doing, the magnetic flux density acting on the side edge of the strip 130 is increased.

What is claimed is:

1. An apparatus for continuously conveying a self-supporting strip formed of magnetic material, comprising:

means having a plurality of spaced apart members defining a free span for suspending a self-supported strip over the span between the members with the members disposed at opposite ends of the span in contact with the strip, and for continuously drawing the strip longitudinally along a predetermined path across said span at a speed causing deformation of said strip within said span in a plane transverse to the width of said strip and normal to the length of said strip, and causing oscillation of said strip within said span about a plane defined by the width and length of said strip;

magnetic means having a plurality of discrete spaced-apart elements providing a plurality of magnetic poles of alternate polarity, disposed between said spaced apart members, facing and separated by a gap from a side edge of said strip with the separation between successive poles along the side edge being less than the width of the strip, for applying a magnetic field to the strip in the direction of the width of the strip transversely to the direction of said path independently of any source of a magnetic field disposed along an opposite side edge of the strip, thereby tending to attract an edge of the strip in the direction of the magnetic means and for attenuating said deformation and the amplitude of said width of said strip;

means for producing a signal indicative of changes in said gap between the side edge of the strip and said magnetic means; and means for controlling said magnetic means in response to the signal so as to maintain said gap substantially constant.

2. The apparatus of claim 1, wherein a plurality of said magnetic means are disposed in the vicinity of opposite side edges of the strip.

3. The apparatus of claim 1, wherein said magnetic means includes arrays of said elements arranged in discrete units disposed along a side edge of the strip with different ones of said units positioned on upstream and downstream sides of means for processing the strip.

4. The apparatus of claim 1, further comprising means encasing said magnetic means for cooling said magnetic means against heat emanating from the apparatus.

5. The apparatus of claim 4, wherein said magnetic means is formed of a plurality of permanent magnets arranged along the side edge of the strip.

6. The apparatus of claim 1 wherein said signal producing means provides a signal indicative of changes in said cap caused by movement of the strip, and said controlling means shifts said magnetic means in the same direction as the movement of said strip to maintain said cap substantially constant.

7. An apparatus for preventing oscillaton of a strip formed of magnetic material, comprising:

means for continuously drawing a strip of magnetic material over a free span along a predetermined path;

first magnetic means spaced apart by a gap from a side edge of said strip for applying a magnetic field to the strip in a direction transverse to said path, thereby imparting tension between said magnetic means and the strip in the direction of the width of the strip, said magnetic means including a plurality of poles of alternate polarity spaced apart along said side edge of said strip with the separation between successive poles being less than the width of the strip;

second magnetic means spaced apart by a gap from the other side edge of said strip for applying a magnetic field to the strip in a direction transverse to said path independently of said first magnetic means, thereby imparting tension between said magnetic means and the strip in the direction of the width of the strip, said magnetic means including a plurality of poles of alternate polarity spaced apart along each of said side edges of said strip; and means for cooling said first and second magnetic means.

8. An apparatus for preventing oscillation of a strip according to claim 7, wherein said cooling means comprises of a non-magnetic casing for enclosing said magnetic means, having an inlet means and an outlet means for passing cooling medium through said casing.

9. An apparatus for continuously coating molten metal on the surface of a magnetic strip, comprising:

a bath for storing molten metal;

means for continuously drawing a strip of magnetic material over a free span along a predetermined path while guiding the strip into said bath to be immersed therein and withdrawing the strip from said bath;

thickness control means for controlling a thickness of molten metal coated on the strip surfaces withdrawn from said bath;

magnetic means having a plurality of discrete spaced-apart elements disposed along each side edge of the strip with each of said elements providing a plurality of spaced apart, magnetic poles of alternate polarity, located downstream of said bath in the vicinity of said thickness control means with said poles facing and spaced apart by gaps from the side edges of said strip with the separation between successive poles along each of the side edges being less than the width of the strip, for applying a magnetic field to the strip in a direction transverse to said path, thereby imparting a tension between said magnetic means and the strip in the direction of the width of the strip and preventing oscillation of the strip;

means for producing signals indicative of changes in said gaps between the side edges of the strip and said magnetic means; and means for controlling said magnetic means in response to the signals to maintain said gaps substantially constant.

10. An apparatus for continuously coating molten metal according to claim 9 wherein pluralities of said elements are arranged in discrete units disposed along said side edges.

11. An apparatus for continuously coating molten metal according to claim 9, wherein said magnetic means is comprised of permanent magnets.

12. An apparatus for continuously coating molten metal according to claim 11, wherein said apparatus is a continuous galvanizing apparatus.

13. An apparatus for continuously coating molten metal according to claim 12 wherein said thickness control means comprises a pair of wiping nozzle means which direct wiping gas toward respective surfaces of the strip to remove excessive coating metal.

14. An apparatus for continuously coating molten metal according to claim 12, further comprising cooling means for cooling said magnetic means.

15. An apparatus for continuously coating molten metal according to claim 14, wherein said cooling means comprises of a non-magnetic casing for enclosing said magnetic means, having an inlet means and an outlet means for passing cooling medium therethrough.

16. An apparatus for continuously coating molten metal according to claim 9, wherein said signal producing means independently detects the position of the side edges of the strip and produces a corresponding detected value and said control means controls the gaps between said magnetic means and corresponding said edges of the strip by shifting said magnetic means in response to the detected value so as to maintain substantially constant gaps therebetween.

17. An apparatus according to claim 7, further comprising:

means for producing a signal indicative of changes in said gaps between the side edges of the strip and said first and second magnetic means caused by movement of said magnetic strip; and means for independently shifting said first and second magnetic means in the direction of said movement of said magnetic strip to maintain said gaps substantially constant.

18. An apparatus for preventing oscillation of strip formed of a magnetic material, comprising:

means for drawing a strip of the magnetic material along a predetermined path;

first and second magnetic means each disposed along different opposed side edges of the strip and each having a plurality of discrete spaced-apart elements providing a plurality of magnetic poles of alternate polarity, located along said path and spaced apart by gaps from opposite side edges of said strip of magnetic material with the separation in the direction of said path between successive poles of opposite polarity along the side edges being less than the width of the strip, for applying magnetic fields to the strip in the direction of the width of said strip and transversely to the direction of said path, whereby said first and second magnetic means tend to individually attract said side edges of said strip;

means for independently producing signals indicative of changes in said gaps between the side edges of the strip and said magnetic means; and control means for independently varying the separation between said first and second magnetic means and the adjacent side edges of the strip by shifting corresponding ones of said magnetic means in response to reception of said signal and thereby maintaining substantially constant gaps between said side edges and said magnetic means.

19. The apparatus of claim 18, wherein said magnetic means is formed as a plurality of discrete units each including a plurality of said elements, with a plurality of said units disposed facing and spaced apart from each of said side edges of said strip.

20. An apparatus according to claim 7, wherein said first and second magnetic means includes a plurality of discrete spaced-apart elements providing said plurality of magnetic poles, the separation between successive elements along the side edges of the strip being less than the width of the strip.

21. The apparatus of claim 18, further comprising:

means for producing a signal indicative of changes in said gaps between the side edges of the strip and said first and second magnetic means caused by movement of said magnetic strip;

means for independently shifting said first and second magnetic means in the direction of said movement of said magnetic strip to maintain said gaps substantially constant.

* * * * *